US006201556B1

(12) United States Patent
Bennett et al.

(10) Patent No.: US 6,201,556 B1
(45) Date of Patent: Mar. 13, 2001

(54) ELECTROGRAPHIC REPRODUCTION APPARATUS LIGHT-EMITTING DEVICE SUPPORT MECHANISM

(75) Inventors: Charles John Bennett, Hilton; Carl Allen Luft, Lima; Jay Leroy Margut, Rochester; William David Van Arsdale, Spencerport, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/443,602

(22) Filed: Nov. 19, 1999

(51) Int. Cl.[7] ..... G03G 15/00; B41J 2/435
(52) U.S. Cl. ..... 347/138; 347/245
(58) Field of Search ..... 347/130, 138, 347/152, 170, 245, 257, 263; 399/110, 118, 164

(56) References Cited

U.S. PATENT DOCUMENTS 4,875,153 * 10/1989 Hons ..... 347/130 X
4,926,198 * 5/1990 Barton et al. ..... 347/130
4,928,119 * 5/1990 Walker et al. ..... 347/263
5,155,506 * 10/1992 Yamaguchi ..... 347/138
5,485,190 * 1/1996 Koetter et al. ..... 347/130

* cited by examiner

*Primary Examiner*—Joan Pendegrass
(74) *Attorney, Agent, or Firm*—Lawrence F. Kessler

(57) ABSTRACT

A mechanism for supporting said light-emitting device in said reproduction apparatus in an electrographic reproduction apparatus having a light-emitting device for forming, on a dielectric support member, a charge pattern corresponding image-wise to information to be reproduced. The light-emitting device support mechanism includes a carriage attached to the reproduction apparatus and movable relative thereto to a first operative position and a second remote position. A pivot mechanism is supported by the carriage so as to provide a pivot axis, the light-emitting device being mounted on the pivot mechanism for movement about the pivot axis. A reference feature is located in the reproduction apparatus, the reference feature located in a predetermined relation relative to the dielectric support member. A movable latch member is selectively engagable with the light-emitting device to move the light-emitting device from a first position, remote from the reference feature, movable with the carriage to the first operative position or the second remote position, to a second position in engagement with the reference feature to be operatively associated with the dielectric support member.

20 Claims, 4 Drawing Sheets

ELECTROGRAPHIC REPRODUCTION APPARATUS LIGHT-EMITTING DEVICE SUPPORT MECHANISM

FIELD OF THE INVENTION

This invention relates in general to writers for electrographic reproduction apparatus, and more particularly to a support mechanism for a light-emitting device which accurately locates the light-emitting device at an operative position within an electrographic reproduction apparatus and enables the light-emitting device to be readily located in a remote position for easy maintenance and service.

BACKGROUND OF THE INVENTION

In typical commercial electrographic reproduction apparatus (copier/duplicators, printers, or the like), a latent image charge pattern is formed on a uniformly charged charge-retentive or photo-conductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

The latent image charge pattern is formed by exposing the dielectric support member to actinic radiation in a desired pattern corresponding image-wise to information to be reproduced. Such exposure may be accomplished optically or electronically. That is, a reflected light image of information to be reproduced may be optically focused on the uniformly charged dielectric support member to alter the charge in an image-wise pattern. Alternately, a light-emitting device, such as a laser or light-emitting diode (LED) array, may be activated according to appropriate electrical signals to alter the uniform charge on the dielectric member to form the desired image-wise charge pattern. Furthermore, in recent high speed optical copier/duplicator devices, it has been common practice to provide an electronic activated light source to form image-wise charge patterns, or to annotate optically formed charge patterns.

The known light emitting devices, commonly referred to as writers, must be accurately located relative to the respective dielectric support members to provide a focused image-wise charge pattern thereon. Furthermore, the known light emitting devices must be removable for maintenance or replacement, or for service on the reproduction apparatus itself. In well-known reproduction apparatus utilizing light-emitting device, such as a laser or (LED) arrays, it is common practice to disconnect the light-emitting device to facilitate removal prior to service and maintenance. This complicates service procedure, and makes it difficult to maintain the desired accurate placement of the light-emitting device within the reproduction apparatus.

SUMMARY OF THE INVENTION

Therefore, this invention is directed to an electrographic reproduction apparatus light emitting device support mechanism which accurately locates the light-emitting device at an operative position within an electrographic reproduction apparatus and enables the light-emitting device to be readily located in a remote position for easy maintenance and service. This is accomplished by a support mechanism which pivots the light-emitting device away from the dielectric support member of the electrographic reproduction apparatus and enables a carriage containing the light-emitting device and power supply to be retracted from the mainframe of the reproduction apparatus. The light-emitting device support mechanism includes a carriage attached to the reproduction apparatus and movable relative thereto to a first operative position and a second remote position. A pivot mechanism is supported by the carriage so as to provide a pivot axis, the light-emitting device being mounted on the pivot mechanism for movement about the pivot axis. A reference feature is located in the reproduction apparatus, the reference feature located in a predetermined relation relative to the dielectric support member. A movable latch member is selectively engagable with the light-emitting device to move the light-emitting device from a first position, remote from the reference feature, movable with the carriage to the first operative position or the second remote position, to a second position in engagement with the reference feature to be operatively associated with the dielectric support member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
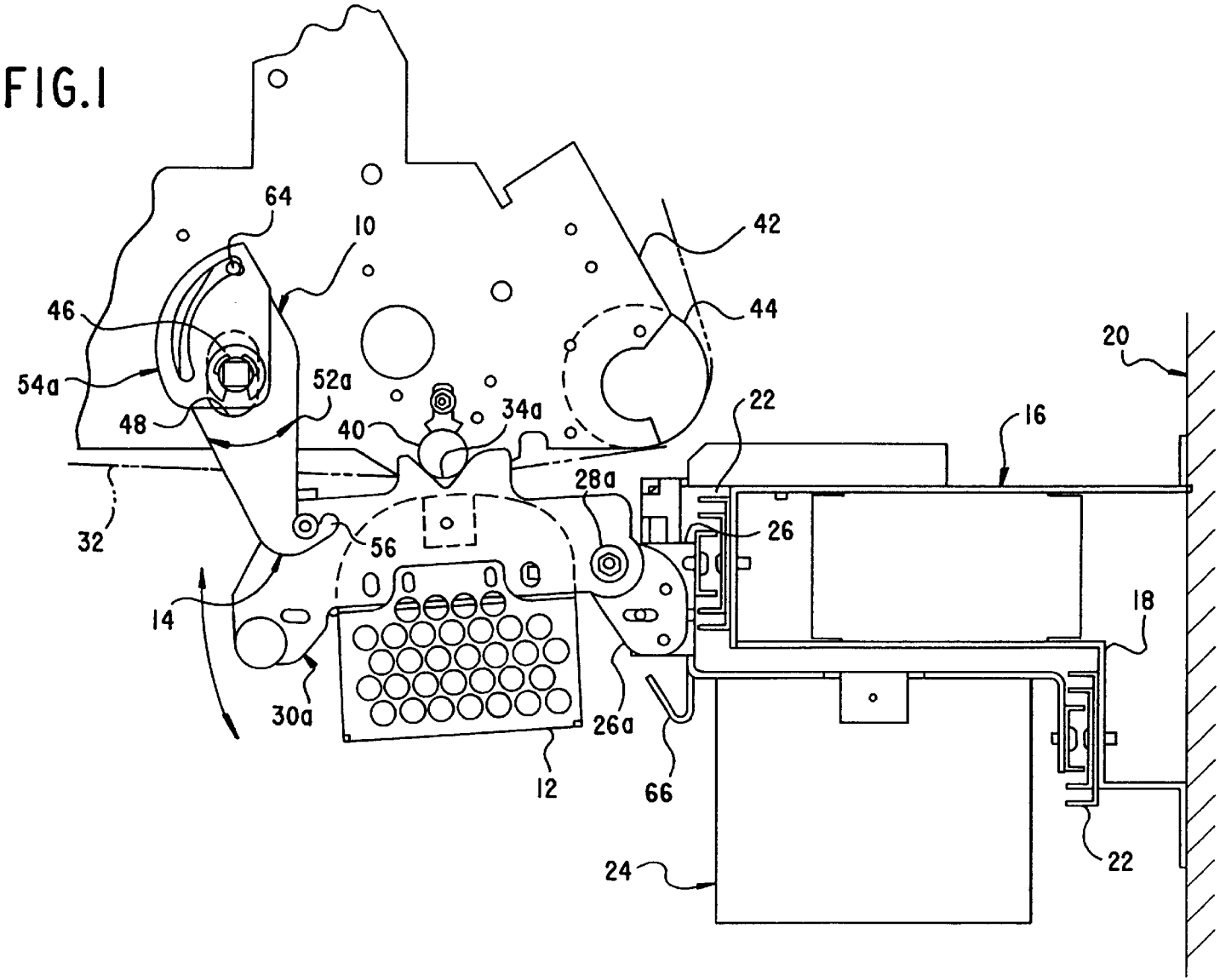
FIG. 1 is a front elevational view of the support mechanism for the electrographic reproduction apparatus light-emitting device according to this invention.

Referring now to the accompanying drawings, FIG. 1 shows support mechanism according to this invention, designated generally by the numeral 10, for an electrographic reproduction apparatus light-emitting device 12. The purpose of the support mechanism 10 is to accurately locate the light-emitting device 12, or any typical electronically controlled digital writer, of an electrographic reproduction apparatus at an operative position within the reproduction apparatus, and enable the light-emitting device to be readily moved from the operative position to a remote position for easy maintenance and service. While the electrographic reproduction apparatus may be for example a printer or copier/duplicator, and the light-emitting device may be for example a laser or LED array, one suitable arrangement for employing the support mechanism according to this invention is shown and fully described in U.S. Pat. No. 5,956,544, issued Sep. 21, 1999, in the names of Stern et al.

The support mechanism 10, according to this invention, for the light-emitting device 12, generally includes a hook latch mechanism 14 and a carriage assembly 16. The carriage assembly 16 includes a frame 18 attached to the machine plate 20 of the reproduction apparatus. The frame 18 carries a pair of slide rails 22. The rails 22, in turn, support a power supply 24 providing electrical power for the light-emitting device 12, and a bracket 26 for mounting of the light emitting device relative to the power supply. The bracket 26 includes a pair of opposed ears 26*a*, 26*b* respectively carrying pivot pins 28*a*, 28*b*. End plates 30*a*, 30*b*, coupled to the light-emitting device 12, are respectively mounted on the pivot pins 28*a*, 28*b* so as to enable the light-emitting device to rotate about an axis defined by an imaginary line through the pivot pins. The power supply 24 supported by the rails 22 in a manner so as locate the power supply relative to the light-emitting device 12 whereby the length of a power cable (not shown) between the light-emitting device and the power supply is minimized. This serves to reduce electromagnetic interference (EMI), and increase the reliability of the power cable and data cable.

Figure 2:
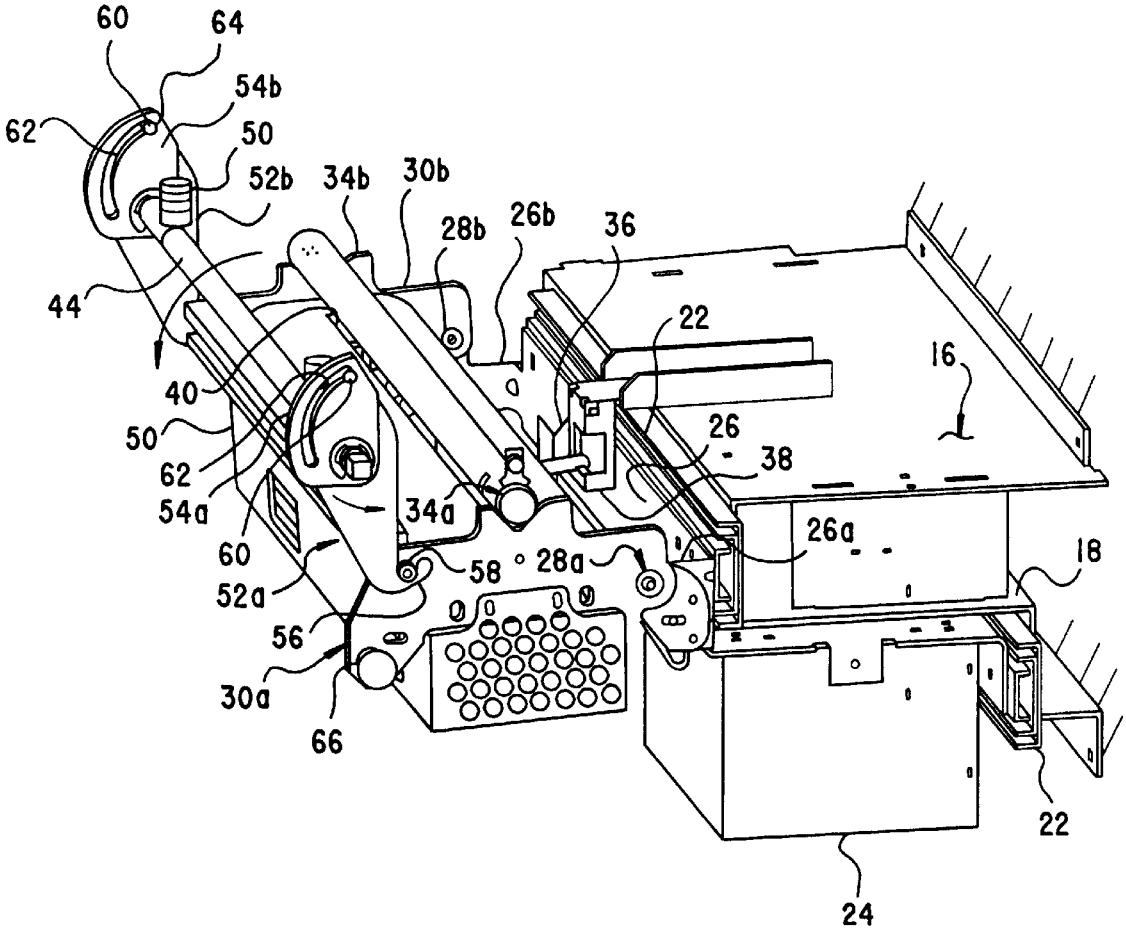
FIG. 2 is a view, in perspective of the support mechanism for the electrographic reproduction apparatus light-emitting device, as shown in FIG. 1, in the operative position.

The light-emitting device 12 must be registered accurately relative to a dielectric support member 32 of the electrographic reproduction apparatus when in operative relation thereto. The accurate registration is the result of the use of a three point mounting system. The three point mounting system, as shown in FIGS. 1 and 2, includes the provision of "V"-shaped notches 34*a*, 34*b* respectively defined in end plates 30*a*, 30*b*, and a center pin 36 adapted to be received in a "V"-shaped notch of a central bracket 38 supported on, and attached to, the frame 18 of the carriage assembly 16. The "V"-shaped notch is oriented in a direction such that when the center pin 36 engages such notch, the light-emitting device 12 is adjustably moved transverse to the dielectric support member 32 (i.e., into/out of the plane of the drawings). Accordingly, the action of the center pin in the "V"-shaped notch accurately locates the light-emitting device 12 in a cross-track direction relative to the dielectric support member.

The notches 34*a*, 34*b* of the end plates 30*a*, 30*b* are adapted to engage a back-up bar 40 for the dielectric support member 32. The dielectric support member back-up bar 40 is mounted at a predetermined positional location in a dielectric support member support frame 42 and forms a reference feature. The support frame 42 includes a plurality of guide rollers 44 (only one guide roller shown in the drawings) which cooperate to form a closed loop path for a web type dielectric support member. The location of the back-up bar 40 describes a particular location for an object plane for the dielectric support member. Accordingly, when the back-up bar 40 is engaged by the "V"-shaped notches 34*a*, 34*b* of the end plates 30*a*, 30*b*, the light-emitting device 12 will be accurately positioned relative to the dielectric support member 32 to assure in-focus writing of images to be reproduced on the dielectric support member.

The light-emitting device 12 is maintained in an operative position relative to the dielectric support member 32 by the hook latch mechanism 14. The hook latch mechanism 14 includes a shaft 46, which is free to move vertically in slots 48 defined in the dielectric support member support frame 42. The shaft 46 is urged in the upward direction (when viewed as in FIG. 1) by two springs 50 which are attached between the shaft and the dielectric support member frame 42. The mechanism 14 further includes a pair of hook devices 52*a*, 52*b*, and a pair of cam assemblies 54*a*, 54*b*. The hook devices 52*a*, 52*b* are supported on the shaft 46, respectively adjacent to the ends of the shaft, for free rotation with respect to the shaft; the cam assemblies 54*a*, 54*b* are mounted on the shaft 46, respectively outboard of the hook devices, for rotation with the shaft.

The hook devices 52*a*, 52*b*, respectively include hook members 56, and hook pins 60. The hook members 56 are cooperable with latch pins 58 fixed to the end plates 30*a*, 30*b* of the light-emitting device 12. The cam assemblies 54*a*, 54*b*, respectively include cam slots 62, each having a detent 64 at one end thereof. The hook pins 60 of the hook devices 52*a*, 52*b* are respectively captured in the cam slots 62. The shape of the cam slots 62 is selected such that the distance between the hook pins 60 and the longitudinal axis of the shaft 44 is controlled, with the distance being at a maximum when the hook pin is in the cam detent 64 at one end of the slot, and at a minimum when the hook pin is at the opposite end of the slot. When it is desired to move the light-emitting device 12 from the operative position (FIGS. 1 and 2) for service or replacement, the cam assemblies 54*a*, 54*b* are rotated with the shaft 46 (in a clockwise direction in the drawings) so as to enable the hook pins 60 to be disengaged from the cam dentents 64.

Figure 3:
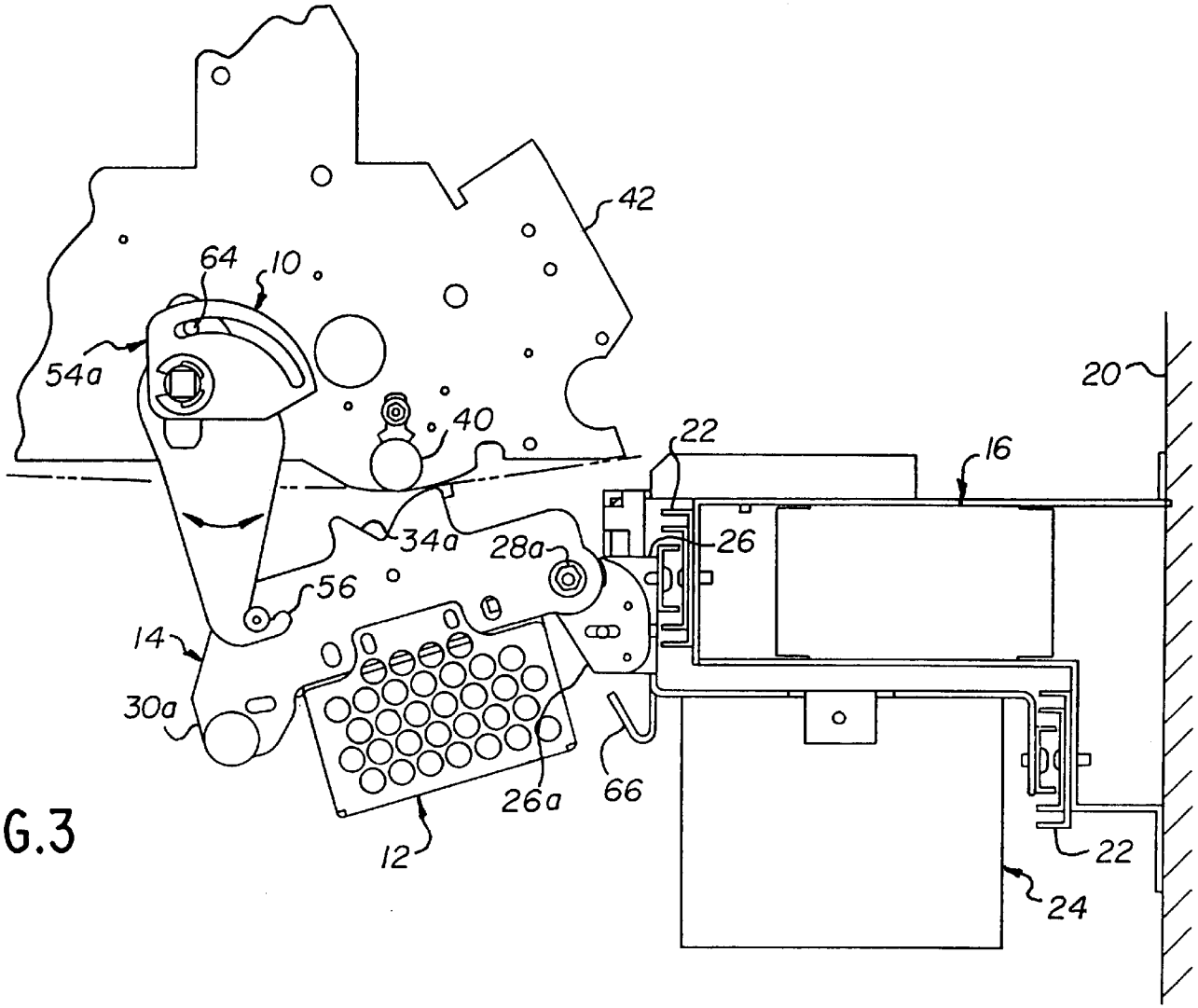
FIG. 3 is a front elevational view of the support mechanism for the electrographic reproduction apparatus light-emitting device, as shown in FIG. 1, in an intermediate position between the operative position shown in FIG. 2 and the remote service position shown in FIG. 4.
Figure 4:
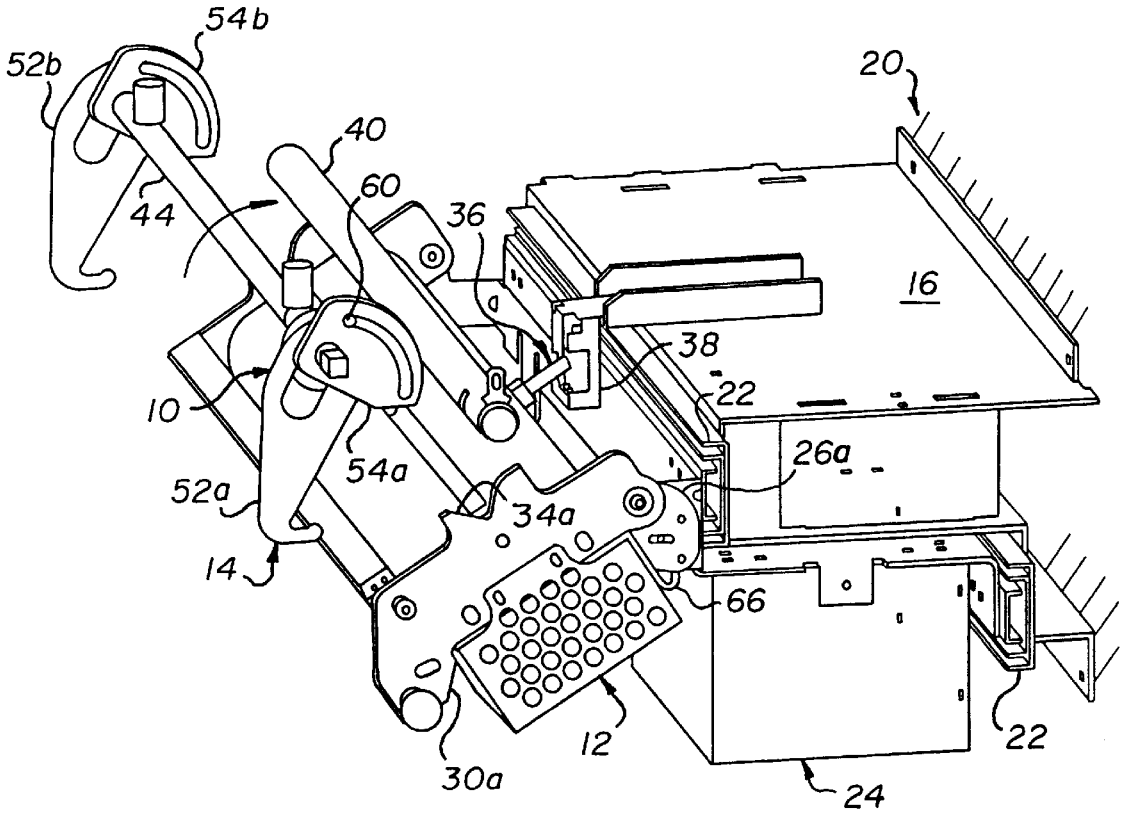
FIG. 4 is a view, in perspective of the support mechanism for the electrographic reproduction apparatus light-emitting device, as shown in FIG. 1, in the remote service position.

Accordingly, as shown in FIG. 3, the hook devices 52*a*, 52*b* are lowered and the light-emitting device 12 pivots about pins 28*a*, 28*b* downwardly to an intermediate position clear of the closed loop path for the dielectric support member 32. The shaft 46 may rotate the cam assemblies farther in the clockwise direction to move the hook pins 60, and thus the hook devices away from the light-emitting device latch pins 58. The light-emitting device 12 then pivots downwardly until it engages against stop members 66 (see FIG. 4). Since the light-emitting device 12 remains attached to the carriage 16 by the pivot pins 28*a*, 28*b*, the light-emitting device endplates 30*a*, 30*b* are disengaged from the back-up bar 40, and the center pin 36 is disengaged from the "V"-shaped notch of the bracket 38. The carriage 16, containing the light-emitting device 12 and power supply 24, is then free to be moved out of the on slides 22 to a remote location, for example external of the mainframe of the reproduction apparatus, for maintenance service or replacement.

In order to reposition the light-emitting device 12 in operative relation to the dielectric support member 32, the carriage 16 is returned in the slides 22 into the mainframe of the reproduction apparatus. The light-emitting device 12 is then pivoted in a counter-clockwise direction into position using a knob 66. The hook members 56 are brought into engagement with the light-emitting device latch pins 58. Once the hook members have secured the light-emitting device 12, the shaft 46 is rotated counter-clockwise so that the cam assemblies 54*a*, 54*b* rotate counter-clockwise. During such rotation, the cam slots 62 cooperate with the hook pins 60 to force the hook members 56 upwardly until the hook pins are located in the cam detents 64. This action serves to pull the light-emitting device 12 up against the back-up bar 40, and locates the center pin 36 in the "V"-shaped notch of the bracket 38. The light-emitting device 12 is thus accurately positioned in the front/rear direction (into/out of the plane of the drawings) by the center pin 36, and spaced in proper operative relation with the dielectric support member 32 by the "V"-shaped notches 34*a*, 34*b* of the endplates 30*a*, 30*b*. Accordingly, the light-emitting device 12 is accurately positioned in proper operative relation to the dielectric support member 132 within the reproduction apparatus. The springs 50 apply the force required to secure the light-emitting device in such operative position.

The major advantage of the light-emitting device support mechanism, according to this invention, is the ability to remove the light-emitting device from the reproduction apparatus mainframe, for example for lens cleaning and servicing, without disconnecting data cables and power cable. This will save service time troubleshooting the light-emitting device, and increase reliability of the data cable and power cable connections.

The invention has been described in detail with particular reference to certain preferred embodiment thereof, but it will be understood that variations and modifications can be effected within the spirit and scope of the invention.

What is claimed is:

1. In an electrographic reproduction apparatus having a light-emitting device for forming, on a dielectric support member, a charge pattern corresponding image-wise to information to be reproduced, a mechanism for supporting said light-emitting device in said reproduction apparatus, said light-emitting device support mechanism comprising:

a carriage attached to said reproduction apparatus and movable relative thereto to a first operative position and a second remote position;

a pivot mechanism supported by said carriage so as to provide a pivot axis, said light-emitting device being mounted on said pivot mechanism for movement about said pivot axis;

a reference feature in said reproduction apparatus, said reference feature located in a predetermined relation relative to said dielectric support member; and a movable latch member selectively engagable with said light-emitting device to move said light-emitting device from a first position, remote from said reference feature, movable with said carriage to said first operative position or said second remote position, to a second position in engagement with said reference feature to be operatively associated with said dielectric support member.

2. The light-emitting device support mechanism according to claim 1 wherein said carriage includes slide guides located in association with said reproduction apparatus so as to enable said light-emitting device to be positioned at said first remote position remote from said reproduction apparatus in a direction transverse to said dielectric support member, or said second position in operative association with said dielectric support member.

3. The light-emitting device support mechanism according to claim 1 wherein said pivot mechanism includes a bracket attached to said carriage for movement therewith, and at least one pivot pin carried by said bracket.

4. The light-emitting device support mechanism according to claim 3 wherein said pivot mechanism further includes at least one end plate mounted on said light-emitting device.

5. The light-emitting device support mechanism according to claim 4 wherein said reference feature includes a central bracket attached to said carriage, said central bracket defining a substantially "V"-shaped notch oriented transverse to said dielectric support member.

6. The light-emitting device support mechanism according to claim 5 wherein said at least one end plate is oriented parallel to said dielectric member, and said reference feature further includes a "V"-shaped notch defined in said at least one end plate.

7. The light-emitting device support mechanism according to claim 6 wherein said movable latch member includes at least one hook device having a hook member engagable with a latch pin connected to said at least one end plate, said hook member being mounted on a shaft for free rotation about the longitudinal axis of said shaft for selective pivoting to a position where said hook member engages said latch pin, or a position where said hook member is out of engagement with said latch pin.

8. The light-emitting device support mechanism according to claim 7 wherein said movable latch member further includes a hook pin attached to said hook device, and at least one cam assembly mounted on said shaft for rotation therewith, said cam assembly defining a cam slot in which said hook pin is captured.

9. The light-emitting device support mechanism according to claim 8 wherein said cam slot in which said hook pin is captured has a shape of selected such that the distance between said hook pins and the longitudinal axis of said shaft is controlled, with the distance being at a maximum when the hook pin is in one end of said slot and at a minimum when the hook pin is in the opposite end of said slot.

10. The light-emitting device support mechanism according to claim 9 wherein said cam slot has a detent for said hook pin at the end of said slot where the distance between said hook pins and the longitudinal axis of said shaft is at a maximum.

11. An electrographic reproduction apparatus having an elongated dielectric support member mounted on a frame for movement about a closed loop path in operative relation with electrographic process stations associated with such path, a light-emitting device for forming, on said dielectric support member, a charge pattern corresponding image-wise to information to be reproduced, a power supply electrically coupled to said light-emitting device, and a mechanism for supporting said light-emitting device and said power supply in said reproduction apparatus, said support mechanism comprising:

a carriage attached to said reproduction apparatus and movable relative thereto to a first operative position and a second remote position, said power supply being mounted on said carriage for movement therewith;

a pivot mechanism supported by said carriage so as to provide a pivot axis, said light-emitting device being mounted on said pivot mechanism, for movement about said pivot axis, in close proximity with said power supply;

a reference feature in said reproduction apparatus, said reference feature located in a predetermined relation relative to said dielectric support member; and a movable latch member selectively engagable with said light-emitting device to move said light-emitting device to a first position, remote from said reference feature, movable with said carriage and said power supply to said first operative position or said second remote position without having to decouple said light-emitting device from said power supply, or to a second position in engagement with said reference feature to be operatively associated with said dielectric support member.

12. The light-emitting device support mechanism according to claim 11 wherein said carriage includes slide guides located in association with said reproduction apparatus so as to enable said light-emitting device to be positioned at said first remote position remote from said reproduction apparatus in a direction transverse to said dielectric support member, or said second position in operative association with said dielectric support member, and said power supply being attached to said side guides.

13. The light-emitting device support mechanism according to claim 11 wherein said pivot mechanism includes a bracket attached to said carriage for movement therewith, and at least one pivot pin carried by said bracket.

14. The light-emitting device support mechanism according to claim 13 wherein said pivot mechanism further includes at least one end plate mounted on said light-emitting device.

15. The light-emitting device support mechanism according to claim 14 wherein said reference feature includes a central bracket attached to said carriage, said central bracket defining a substantially "V"-shaped notch oriented transverse to said dielectric support member.

16. The light-emitting device support mechanism according to claim 15 wherein said at least one end plate is oriented parallel to said dielectric member, and said reference feature further includes a "V"-shaped notch defined in said at least one end plate.

17. The light-emitting device support mechanism according to claim 16 wherein said movable latch member includes at least one hook device having a hook member engagable with a latch pin connected to said at least one end plate, said hook member being mounted on a shaft for free rotation about the longitudinal axis of said shaft for selective pivoting to a position where said hook member engages said latch pin, or a position where said hook member is out of engagement with said latch pin.

18. The light-emitting device support mechanism according to claim 17 wherein said movable latch member further includes a hook pin attached to said hook device, and at least one cam assembly mounted on said shaft for rotation therewith, said cam assembly defining a cam slot in which said hook pin is captured.

19. The light-emitting device support mechanism according to claim 18 wherein said cam slot in which said hook pin is captured has a shape of selected such that the distance between said hook pins and the longitudinal axis of said shaft is controlled, with the distance being at a maximum when the hook pin is in one end of said slot and at a minimum when the hook pin is in the opposite end of said slot.

20. The light-emitting device support mechanism according to claim 19 wherein said cam slot has a detent for said hook pin at the end of said slot where the distance between said hook pins and the longitudinal axis of said shaft is at a maximum.

* * * * *